US012668415B2

(12) United States Patent
Jobe

(10) Patent No.: US 12,668,415 B2
(45) Date of Patent: Jun. 30, 2026

(54) COMPOSTABLE WALL BULK SHIPPER

(71) Applicant: Vericool World, LLC, San Ramon, CA (US)

(72) Inventor: Darrell Jobe, Livermore, CA (US)

(73) Assignee: Vericool World LLC, San Ramon, CA (US)

( * ) Notice: Subject to any disclaimer, the term of this patent is extended or adjusted under 35 U.S.C. 154(b) by 0 days.

(21) Appl. No.: 16/794,738

(22) Filed: Feb. 19, 2020

(65) Prior Publication Data

US 2020/0270053 A1 Aug. 27, 2020

Related U.S. Application Data

(60) Provisional application No. 62/810,346, filed on Feb. 25, 2019.

(51) Int. Cl.

| | |
|---|---|
| ***B65D 88/12*** | (2006.01) |
| ***B65D 77/04*** | (2006.01) |
| ***B65D 81/38*** | (2006.01) |
| ***B65D 90/08*** | (2006.01) |
| *B65D 88/52* | (2006.01) |

(52) U.S. Cl.

CPC ..... *B65D 88/12* (2013.01); *B65D 77/0466* (2013.01); *B65D 81/3823* (2013.01); *B65D 81/386* (2013.01); *B65D 90/08* (2013.01); *B65D 88/52* (2013.01); *B65D 2519/00273* (2013.01)

(58) Field of Classification Search

CPC .... B65D 88/12; B65D 88/52; B65D 77/0466; B65D 90/08; B65D 2519/00273; B65D 81/3823; B65D 81/386

USPC ..... 220/1.5

See application file for complete search history.

(56) References Cited

U.S. PATENT DOCUMENTS

| | | | |
|---|---|---|---|
| 1,497,159 | A | 6/1924 | Herbert |
| 1,641,030 | A | 8/1927 | Moses |
| 1,691,178 | A | 11/1928 | Beaman |
| 1,701,323 | A | 2/1929 | Martin |
| 1,715,814 | A | 6/1929 | Brown |
| 1,845,970 | A | 2/1932 | Katz |
| 1,904,400 | A | 4/1933 | Bangs et al. |
| 2,109,789 | A | 3/1938 | Bangs et al. |
| 2,194,301 | A | 3/1940 | Fourness et al. |

(Continued)

FOREIGN PATENT DOCUMENTS

| | | |
|---|---|---|
| CN | 108177875 | 6/2018 |
| EP | 2000422 | 5/2012 |

(Continued)

OTHER PUBLICATIONS

PCT International Search Report and Written Opinion in International Appln. No. PCT/US2020/018692, dated Jun. 18, 2020, 13 pages.

*Primary Examiner* — Andrew D Perreault
(74) *Attorney, Agent, or Firm* — Fish & Richardson P.C.

(57) ABSTRACT

A compostable wall includes a solid inner sheet and a solid outer sheet, both formed primarily of molded plant fiber. The inner sheet and the outer sheet are joined together along adjacent edges to form a generally planar body having a length of at least 2 feet, a width of at least 2 feet, a thickness that is less than the length and width, and an interior space between the inner sheet and the outer sheet. The interior space contains one or more of air, starch or loose plant fiber.

17 Claims, 3 Drawing Sheets

(56) References Cited

U.S. PATENT DOCUMENTS

| | | | | |
|---|---|---|---|---|
| 2,231,981 | A | 2/1941 | Zalkind | |
| 2,326,817 | A | 8/1943 | Zalkind | |
| 2,808,976 | A | 10/1957 | Merle | |
| 2,828,903 | A | 4/1958 | Adkins | |
| 2,872,095 | A | 2/1959 | Adams | |
| 2,885,135 | A | 5/1959 | Friday | |
| 2,927,720 | A | 3/1960 | Adams | |
| 2,941,708 | A | 6/1960 | Harold et al. | |
| 3,335,653 | A * | 8/1967 | Heimann | B60P 3/20 62/239 |
| 3,365,092 | A | 1/1968 | Blessing | |
| 3,416,692 | A | 12/1968 | Delbert et al. | |
| 3,513,531 | A | 5/1970 | Humphress et al. | |
| 3,539,075 | A | 11/1970 | Bautista | |
| 3,678,703 | A | 7/1972 | Cornish et al. | |
| 3,746,204 | A | 7/1973 | Nagai | |
| 3,889,486 | A * | 6/1975 | Hinckley | B65D 88/14 62/298 |
| 4,593,536 | A * | 6/1986 | Fink | B60P 3/20 62/239 |
| 5,062,527 | A | 11/1991 | Westerman | |
| 5,180,060 | A | 1/1993 | Forti et al. | |
| 5,208,267 | A | 5/1993 | Neumann et al. | |
| 5,244,094 | A | 9/1993 | Graff et al. | |
| 5,266,763 | A | 11/1993 | Colombo | |
| 5,284,294 | A | 2/1994 | Floyd | |
| 5,307,986 | A | 5/1994 | Schuster | |
| 5,564,570 | A | 10/1996 | Jaszai | |
| 5,634,569 | A | 6/1997 | De Coster | |
| 5,758,513 | A | 6/1998 | Smith | |
| 5,896,641 | A | 4/1999 | Yamada et al. | |
| 5,897,017 | A | 4/1999 | Lantz | |
| 5,924,302 | A | 7/1999 | Derifield | |
| 6,257,764 | B1 | 7/2001 | Lantz | |
| 6,325,281 | B1 | 12/2001 | Grogan | |
| 6,619,500 | B1 | 9/2003 | Lantz | |
| 6,740,373 | B1 | 5/2004 | Swoboda et al. | |
| 6,938,968 | B2 | 9/2005 | Tanimoto et al. | |
| 7,332,214 | B2 | 2/2008 | Ozasa et al. | |
| 8,557,367 | B2 | 10/2013 | Netravali et al. | |
| 8,617,684 | B2 | 12/2013 | Nomura et al. | |
| 8,763,811 | B2 | 7/2014 | Lantz | |
| 9,550,618 | B1 | 1/2017 | Jobe | |
| 9,856,608 | B1 | 1/2018 | Chung et al. | |
| 10,046,901 | B1 | 8/2018 | Jobe | |
| 10,059,495 | B1 | 8/2018 | Korustan et al. | |
| 10,625,925 | B1 | 4/2020 | Jobe | |
| 10,954,057 | B2 * | 3/2021 | Waltermire | B65D 5/0065 |
| 2002/0008113 | A1 | 1/2002 | Fuji et al. | |
| 2003/0082357 | A1 | 5/2003 | Gokay et al. | |
| 2003/0102317 | A1 | 6/2003 | Gordon | |
| 2003/0146224 | A1 | 8/2003 | Fuji et al. | |
| 2003/0152724 | A1 | 8/2003 | Swoboda et al. | |
| 2003/0217948 | A1 | 11/2003 | Lantz | |
| 2004/0058119 | A1 | 3/2004 | Wynne | |
| 2004/0211697 | A1 * | 10/2004 | Nakano | B65D 81/052 206/521 |
| 2005/0202229 | A1 | 9/2005 | Ozasa et al. | |
| 2006/0065704 | A1 | 3/2006 | Chang | |
| 2006/0230778 | A1 | 10/2006 | Williams | |
| 2007/0051782 | A1 | 3/2007 | Lantz | |
| 2008/0289302 | A1 | 11/2008 | Vulpitta | |
| 2009/0001086 | A1 | 1/2009 | Roderick et al. | |
| 2009/0265875 | A1 | 10/2009 | Clamp et al. | |
| 2010/0258574 | A1 | 10/2010 | Bentley | |
| 2010/0314397 | A1 | 12/2010 | Williams et al. | |
| 2011/0042449 | A1 | 2/2011 | Copenhaver et al. | |
| 2011/0100868 | A1 | 5/2011 | Lantz | |
| 2011/0248038 | A1 | 10/2011 | Mayer | |
| 2012/0097067 | A1 | 4/2012 | Fascio | |
| 2012/0279896 | A1 | 11/2012 | Lantz | |
| 2013/0112694 | A1 | 5/2013 | Bentley | |
| 2013/0112695 | A1 | 5/2013 | Roskoss | |
| 2013/0140317 | A1 | 6/2013 | Roskoss | |
| 2014/0021208 | A1 | 1/2014 | Anti et al. | |
| 2014/0093704 | A1 | 4/2014 | Shi et al. | |
| 2014/0144161 | A1 | 5/2014 | Pointer et al. | |
| 2014/0319018 | A1 | 10/2014 | Collison | |
| 2014/0353317 | A1 | 12/2014 | Ranade et al. | |
| 2015/0158656 | A1 | 6/2015 | McKinnon | |
| 2015/0336730 | A1 | 11/2015 | Shields | |
| 2015/0344211 | A1 | 12/2015 | Moon | |
| 2016/0023837 | A1 | 1/2016 | Furneaux et al. | |
| 2016/0052692 | A1 | 2/2016 | Branham | |
| 2016/0311604 | A1 | 10/2016 | Qiu | |
| 2016/0362240 | A1 | 12/2016 | Ferracamo, Jr. | |
| 2017/0043937 | A1 | 2/2017 | Lantz | |
| 2017/0066582 | A1 | 3/2017 | Vogel et al. | |
| 2018/0029776 | A1 | 2/2018 | Chung et al. | |
| 2018/0086538 | A1 | 3/2018 | Jobe | |
| 2018/0215525 | A1 | 8/2018 | Vogel et al. | |
| 2018/0229916 | A1 | 8/2018 | Jobe | |
| 2018/0229917 | A1 | 8/2018 | Jobe | |
| 2018/0237184 | A1 | 8/2018 | Jobe | |
| 2018/0237206 | A1 | 8/2018 | Jobe | |
| 2018/0305109 | A1 | 10/2018 | Jobe | |
| 2018/0334308 | A1 | 11/2018 | Moore et al. | |
| 2019/0329961 | A1 | 10/2019 | Jobe | |
| 2020/0102139 | A1 | 4/2020 | Jobe | |
| 2020/0122909 | A1 | 4/2020 | Jobe | |
| 2020/0140165 | A1 | 5/2020 | Soto et al. | |

FOREIGN PATENT DOCUMENTS

| | | |
|---|---|---|
| JP | H10-236545 | 9/1998 |
| JP | 2000-053180 | 2/2000 |
| JP | 2000-229676 | 8/2000 |
| JP | 2000-255640 | 9/2000 |
| JP | 2003-300565 | 10/2003 |
| JP | 2014-189307 | 10/2014 |
| JP | 2014-189326 | 10/2014 |
| KR | 20-0438192 | 1/2008 |
| KR | 20-0443141 | 1/2009 |
| WO | WO 99/54228 | 10/1999 |
| WO | WO 2006/117801 | 11/2006 |

* cited by examiner

COMPOSTABLE WALL BULK SHIPPER

CROSS-REFERENCE TO RELATED APPLICATION

This application claims the benefit of U.S. Provisional Patent Application No. 62/810,346, Filed Feb. 25, 2019, the contents of which are incorporated by reference herein.

TECHNICAL FIELD

This invention relates to a bulk shipper.

BACKGROUND

A conventional bulk shipper, e.g., a large crate, box or similar container that would be placed on a pallet for transport, has a body with walls formed of wood, metal, or similar rigid material, although in some situations the walls can be cardboard or a molded plastic, e.g., polyethylene. Conventional bulk shippers generally are not compostable. Consequently, disposal of bulk shippers can be a problem.

SUMMARY

A bulk shipper is described that includes compostable walls.

In general, in one aspect, a compostable or recyclable wall for forming a container includes a solid first sheet and a solid second sheet, both formed primarily of molded plant fiber. The first sheet and the second sheet are joined together along adjacent edges to form a generally planar body having a length of at least 2 feet, a width of at least 2 feet, a thickness that is less than the length and width, and an interior space between the first sheet and the second sheet. The interior space contains one or more of air, starch or loose plant fiber.

The foregoing and other implementations can each optionally include one or more of the following features, alone or in combination.

The wall may include a moisture barrier. The moisture barrier may be a coating on the compostable wall.

The interior space may be filled with just air. The interior space may be filled with loose plant fiber.

The first sheet may have a substantially planar main portion and a rim that extends at an angle relative to the main portion. The rim may extend at an oblique angle relative to the main portion. The rim may extend at a right angle relative to the main portion. The man portion may be flat. The main portion may include at least one groove.

In general, in one aspect, a compostable or recyclable bulk shipper includes a plurality of walls including four side walls, a ceiling and a floor. Each of the plurality of walls includes a solid inner sheet and a solid outer sheet, both formed primarily of molded plant fiber. The inner sheet and the outer sheet are joined together along adjacent edges to form a generally planar body having a length of at least 2 feet, a width of at least 2 feet, a thickness that is less than the length and width, and an interior space between the inner sheet and the outer sheet. The interior space contains one or more of air, starch or loose plant fiber. The side walls, floor and ceiling are secured to form the bulk shipper as a generally rectangular right prism having an interior volume of at least 8 cubic feet.

The foregoing and other implementations can each optionally include one or more of the following features, alone or in combination.

The floor may be strengthened with corrugated walls. The inner sheet of at least one wall may be grooved.

The side walls, floor and ceiling may be secured to each other by interlocked complementary shapes. The side walls, floor and ceiling may be secured to each other using an adhesive.

In general, in one aspect, a bulk shipping system includes a plurality of walls including four side walls, a ceiling, and a floor. Each of the plurality of walls includes a solid inner sheet and a solid outer sheet, both formed primarily of molded plant fiber. The inner sheet and the outer sheet are joined together along adjacent edges to form a generally planar body having a length of at least 2 feet, a width of at least 2 feet, a thickness that is less than the length and width, and an interior space between the inner sheet and the outer sheet. The interior space contains one or more of air, starch or loose plant fiber. The side walls, floor and ceiling are secured to form the bulk shipper as a generally rectangular right prism having an interior volume of at least 8 cubic feet. The bulk shipping system includes a base configured to support the bulk shipper. The bulk shipping system includes one or more coolant packs positioned in the interior volume adjacent to one or more of the plurality of walls.

The foregoing and other implementations can each optionally include one or more of the following features, alone or in combination.

The base may be a pallet. The base may be formed primarily of molded plant fiber.

The bulk shipping system may include one or more insulating pads positioned in the interior volume adjacent to one or more of the plurality of walls. Each insulating pad may be secured to the inner sheet of an adjacent wall.

Potential advantages may include (and are not limited to) one or more of the following. The plurality of walls forming the bulk shipper are compostable or recyclable, so all of the components are easily disposable. If present, a moisture barrier layer, in part or fully, enclosing the insulating material is compostable or recyclable, and also easily disposed.

The details of one or more embodiments are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Initially, some terminology may be beneficial. "Biodegradable" simply means that a product will eventually disintegrate into to innocuous material. "Recyclable" indicates that a product can be reused or treated in order to be made suitable for reuse.

"Compostable" indicates both that a product will decompose quickly, e.g., within 180 days, and that the product will decompose into material that can be used as fertilizer (e.g., per ASTM D6400 or EN 13432). Products that are "biodegradable" need not be (and usually aren't) "compostable."

First, since there is no particular time limit for a "biodegradable" product to disintegrate, it need not decompose quickly. For example, even aluminum cans will biodegrade given several centuries. Moreover, even a biodegradable product that decomposes quickly might not provide a material that is suitable as fertilizer.

Most bulk shippers are not compostable. However, one technique for providing a compostable bulk shipper is to make side walls, a floor, and a ceiling from a molded solid inner sheet and a molded solid outer sheet formed primarily of plant fiber, joined together along adjacent edges to form a generally planar body, with an interior space between the inner sheet and outer sheet filled with air, starch, or loose plant fiber.

Thermal insulation for a bulk shipper could be provided by placing a plastic material such as expanded polystyrene (e.g., Styrofoam), e.g., in sheet or pellet form, within the interior volume of the shipper that holds the goods being shipped. However, polystyrene is not recyclable or compostable. Similarly, plastics are often not recyclable or compostable. Consequently, disposal of the insulating material can be a problem. The bulk shipper described below can provide thermal insulation while still being compostable or recyclable.

Figure 1:
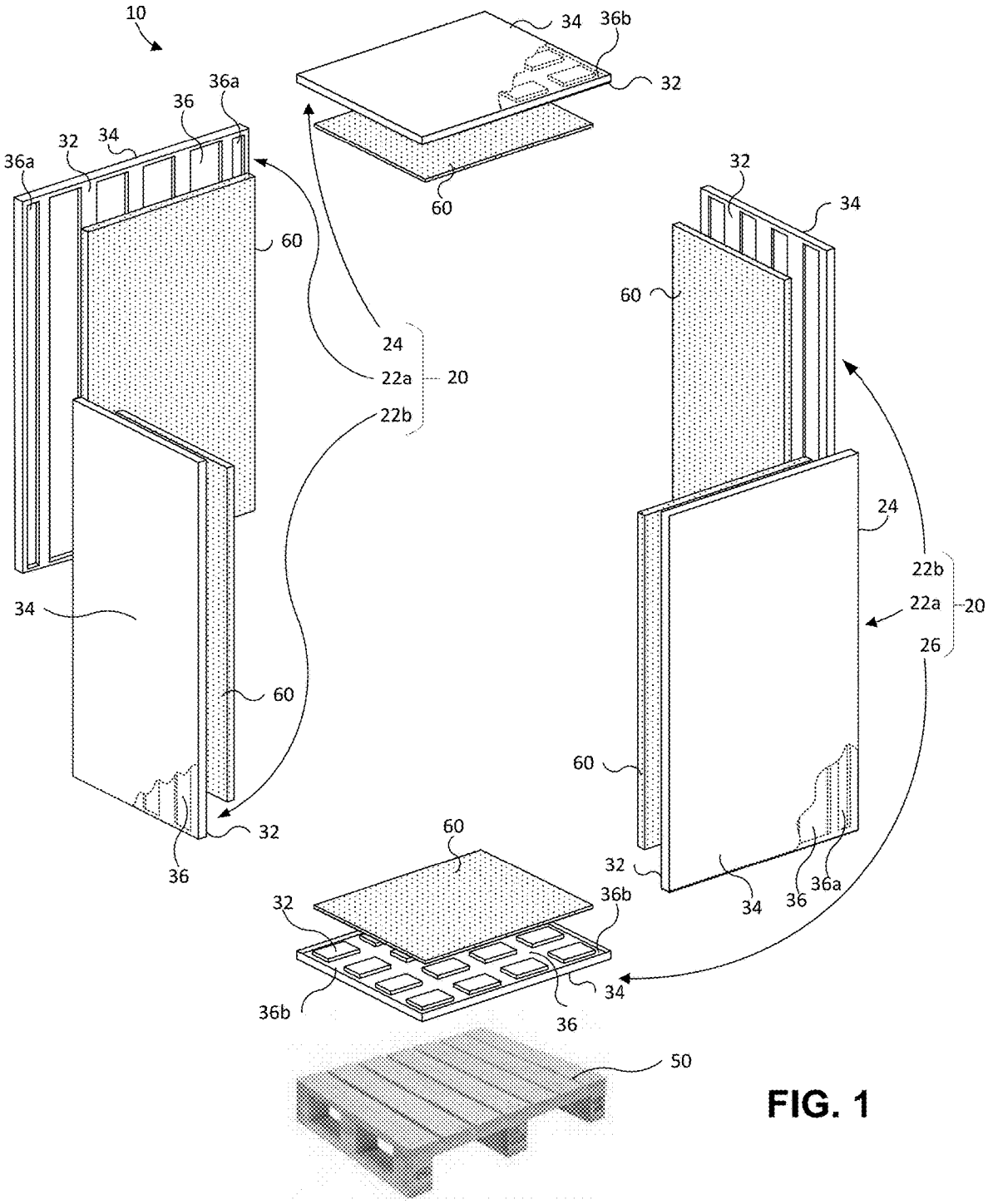
FIG. 1 is a schematic exploded view of a compostable bulk shipper.

Referring to FIG. 1, a compostable bulk shipper 10 has a plurality of walls 20 including four side walls 22 (including a first pair of parallel side walls 22*a* and a second pair of parallel side walls 22*b*), a ceiling 24, and a floor 26.

Figure 2:
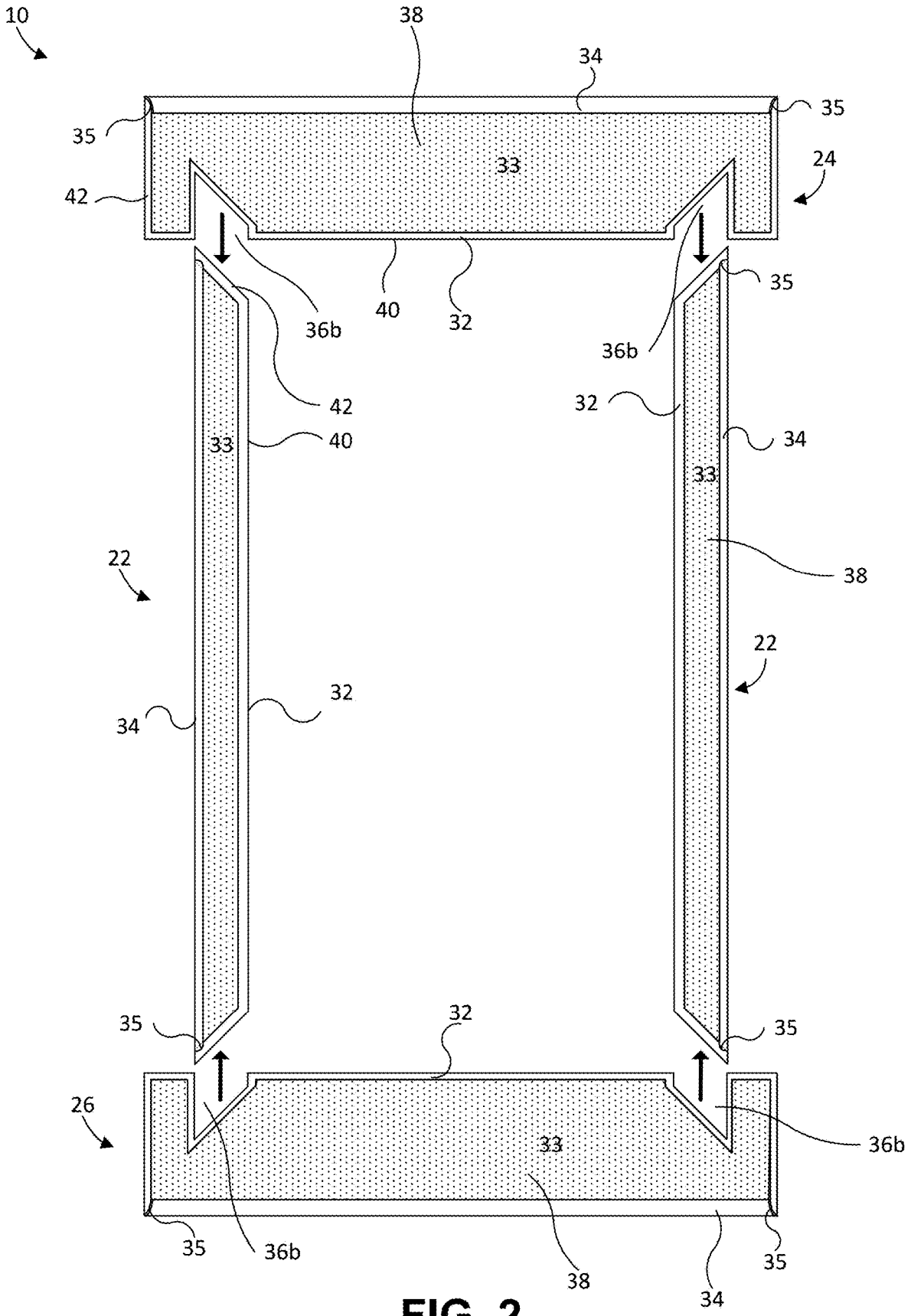
FIG. 2 is a schematic cross-sectional view of a compostable bulk shipper.

As shown in FIGS. 1 and 2, each wall 20 includes an inner sheet 32 and an outer sheet 34. The inner sheet 32 and the outer sheet 34 are solid and formed primarily of molded plant fiber. Adjacent edges of the inner sheet 32 and the outer sheet 34 are joined together to form the wall 20 as a generally planar body. The planar body is generally rectangular in shape, although other shapes are possible. The planar body has a length of at least 2 feet, a width of at least 2 feet, and a thickness of at least 0.5 inches and up to 10 inches. There is no particular upper limit for the length and width of the body, although as a practical matter the bulk shipper would not be larger than a cargo container, e.g., about 8×8×15 feet.

The inner sheet 32 and the outer sheet 34 each can be 0.7 mm to 10 mm thick. The thickness of the inner sheet 32 and the other sheet 34 can be substantially uniform across its area.

At least one of the inner sheet 32 or outer sheet 34 includes a raised rim or lip 42 that is angled relative to the plane of the main surface 42 of the sheet and projects toward the other sheet. For example, the outer sheet 34 can be a generally flat sheet without the rim or lip, and the inner sheet 32 can include both a generally flat portion 40 and a raised rim or lip 42 that can join to the edges of the outer sheet 34, as illustrated in FIG. 2.

Along one, some or all edges of the sheet, the rim or lip 42 can project at a right angle relative to the main portion 40 of the sheet. Thus, the rim or lip 42 can provide a "flat" rim around some or all edges of the wall. Along one, some or all edges of the sheet, or the rim or lip 42 can project at an oblique angle relative to the main portion 40 of the sheet. Thus, the rim or lip 42 can provide a bevel around some or all edges of the wall.

In some implementations, both the inner sheet 32 and the outer sheet 34 can be include substantially flat portions with raised rims or lips that can join with the raised rims or lips of the other sheet. In some implementations, the inner sheet 32 and the outer sheet 34 can have a combination of raised rims and lips to join the sheets together. For example, alternating portions of the edges of the inner sheet 32 and the outer sheet 34 can have raised rims or lips that are joined together.

The inner sheet 32 of the wall 20 can be flat. Alternatively, the inner sheet 32 can have or be molded to provide one or more grooves 36. Some or all of the grooves 36 can provide air circulation, e.g., to ensure that cold air can circulate to improve temperature uniformity. Additionally, some or all of the grooves 36 can be configured to interlock with other walls 20 (discussed in more detail below).

The inner sheet 32 and the outer sheet 34 are joined to together along their adjacent edges to define an interior space 38 within the wall 20. The interior space 38 can contain one or more of air, starch, or loose plant fiber, which can provide insulation and remain compostable. For example, the interior space 38 can be filled entirely with air. In another example, the interior space 38 can be filled with starch, e.g., powder or compacted pellets. In another example, the interior space 38 can be filled with loose plant fiber, save for the air gaps between the plant fibers. In another example, the interior space 38 can be filled with a combination of air, starch, and/or loose plant fiber. The combination of the thickness of the inner sheet 34 and outer sheet 36, in conjunction with the insulative material in the interior space 38, can provide the wall with thermal insulation comparable to extruded polystyrene of comparable thickness.

Figure 3:
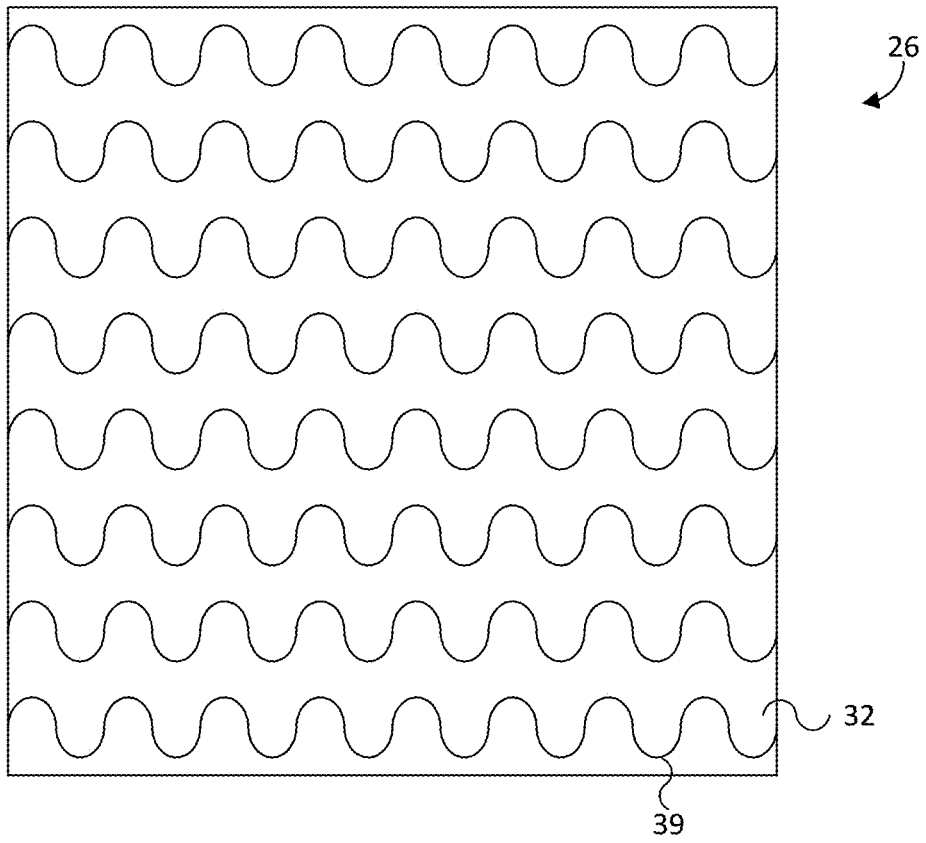
FIG. 3 is a schematic top-down view of a floor of a compostable bulk shipper.

Referring now to FIG. 3, in some implementations, one or more of the walls, e.g., the floor 26, is strengthened. Strengthening can be done, for example, using corrugated layers 39. The corrugated layers 39 can extend from the inner sheet 32 through the interior space 38 to the outer sheet 34. In this configuration, the oscillations of the corrugation would be visible in a plan view of the wall, e.g., a top view of the floor 26. The corrugated layers 39 can be made of molded compostable plant fibers. Although FIG. 3 illustrates the corrugation as extending across the entire wall, the corrugated layers 39 could be provided in only some areas of the wall.

In some implementations, the floor 26 is strengthened by filling the interior space 38 with sufficient starch and/or plant fibers such that the floor 26 can support an applied weight without collapsing or breaking (e.g., the floor 26 is able to support heavy cargo). In some implementations, the walls 22*a*, 22*b* and the ceiling 24 are similarly strengthened. Alternatively, in some implementations, the walls 22*a*, 22*b* and the ceiling 24 are not strengthened.

Referring again to FIG. 1, in some implementations, the floor 26 can be configured to sit or be secured to a base 50. The base 50 can be, for example, a standard wooden shipping pallet. In another example, the base 50 can also be formed of a compostable plant fiber.

Referring now to FIG. 2, the inner sheet 32 and the outer sheet 34 can be joined together along an adjacent edge 35. In some implementations, an adhesive (e.g., heat pressed adhesive) joins the inner sheet 32 and the outer sheet 34 along the adjacent edge 35. In some implementations, the inner sheet 32 and the outer sheet 34 are joined along the edge 35 by interlocking parts (e.g., snap-fit of complementary shapes). For example, the inner sheet 32 and the outer sheet 34 can have rims that are complementary shapes configured to interlock. The adhesive can act as seal, e.g., be fluid-impermeable. This can lock the material, e.g., air or plant fiber, in the interior space 38.

The inner sheets 32 of the first pair of parallel side walls 22*a* have grooves 36*a* configured to receive the side edges of the second pair of parallel side walls 22*b*. For example, each of the first pair of parallel side walls 22*a* have two grooves 36*a* running vertically from a top edge of the side wall 22*a* to a bottom edge of the side wall 22*a*. The two grooves 36*a* can run along the opposite side edges of the wall 22*a*. The grooves 36*a* are complementary shapes of the side edges of the side walls 22*b*; each side wall 22*b* can be inserted into a grooves 36*a* to interlock the side wall 22*a* to the side wall 22*b*.

The inner sheet 32 of the ceiling 24 has grooves 36*b* configured to receive the first pair of parallel side walls 22*a* and the second pair of parallel side walls 22*b*. For example, the grooves 36*b* in the ceiling 24 run substantially around the perimeter of the inner sheet 32 of the ceiling 24. The grooves 36*b* are complementary shapes of the top edges of the first pair of the parallel side walls 22*a* and the top edges of the second pair of parallel side walls 22*b*; each side wall 22 can be inserted into a groove 36*b* in the ceiling 24 to interlock the ceiling 24 to the side walls 22*a* and the side walls 22*b*.

Similarly, the floor 26 has grooves 36*b* configured to receive the first pair of parallel side walls 22*a* and the second pair of parallel side walls 22*b*. For example, the grooves 36*b* in the floor 26 run substantially around the perimeter of the inner sheet 32 of the floor 26. The grooves 36 are complementary shapes of the bottom edges of the first pair of the parallel side walls 22*a* and the bottom edges of the second pair of parallel side walls 22*b*; each side wall 22 can be inserted into a groove 36*b* in the floor 26 to interlock the floor 26 to the side walls 22*a* and the side walls 22*b*.

Alternatively, the first pair of parallel side walls 22*a* and the second pair of parallel side walls 22*b* can also have grooves 36 that run along the top edge of their inner sheets 32 and/or grooves 36 that run along the bottom edge of their inner sheets 32. These grooves at the top and/or bottom edges of the inner sheets can be configured to receive the edges of the ceiling 24 and/or the edges of the floor 26. For example, a top edge of the first pair of the parallel side walls 22*a* and a top edge of the second pair of the parallel side walls 22*b* have grooves that are complementary shapes of the ceiling 24 that interlock the ceiling 24 to the side walls 22*a* and the side walls 22*b*.

The side walls 22, floor 24 and ceiling 26 are joined and secured to form the bulk shipper as a generally rectangular right prism having an interior volume of at least 8 cubic feet.

In some implementations, the walls 20 are joined and secured to one another using adhesives in lieu of or in addition to the interlocking edges and grooves 36. For example, the side walls 22 can be glued or heat pressed to the ceiling 24 and/or the floor 26. In another example, the walls 22, the ceiling 24, and/or the floor 26 have an adhesive (e.g., glue) in the grooves 36 that secure the walls 22, the ceiling 24, and the floor 26 together.

In some implementations, the walls 20 are joined and secured to one another using fasteners (e.g., screws, nuts, bolts, clamps, clips) in lieu of or in addition to the interlocking edges and grooves 36. For example, the ceiling 24 can be secured to the walls 22 by using a screw fastener to join them together. In another example, the floor 26 interlocks with the walls 22 and is further secured using a nut and bolt fastener.

To manufacture the molded walls 20, the plant fibers are ground to the appropriate size and added to a liquid to form a slurry. For example, used paper products, e.g., cardboard, can be recycled by grinding the paper product and adding water to form a recycled wood pulp. A small amount of binder or similar adhesive can also be mixed into the slurry. Also if appropriate, the moisture barrier material is added to the slurry. The slurry is then fed to a vacuum former to create a mold of the desired shape, e.g., the inner sheet 32 or the outer sheet 34. In brief, a screen having the desired shape for the inner sheet 32 or the outer sheet 34 is lowered into a reservoir of the slurry, and vacuum is applied to suction the fibrous material (and additives) onto the screen. The screen is removed from the reservoir, and can be placed into a mating plate. This can compress the slurry accumulated on the screen to remove liquid and form the sheet. Optionally heat can be applied. The walls 20 can then be assembled, e.g., by joining the inner sheet 32 and the outer sheet 34.

An example of the compostable material for the inner sheet 32 and outer sheet 34 of the walls 20 is organic fiber, e.g., plant fiber, such as paper (whether paper is compostable or recyclable can depend on the thickness, size and porosity of the body). As noted above, the organic fiber can be formed into the inner sheet 32 and outer sheet 34 of the walls 20 by mixing fibers into a pulp, e.g., paper pulp or pulp of vegetable fibers, and then extruding the pulp or compressing the pulp in a mold.

In some implementations, the inner sheet 32 and outer sheet 34 of the walls 20 consist of plant fiber. In some cases, a combination of starch and plant fiber can be used; the body can consist of starch and plant fiber. In some implementations, the inner sheet 32 and outer sheet 34 of the walls 20 consist of plant fiber and the binder. In some implementations, the inner sheet 32 and outer sheet 34 of the walls 20 consist of plant fiber, the binder, and the moisture barrier material.

In some implementations, a moisture barrier layer (e.g., wax coating or film) is used to increase resistance of the wall 20 to water or condensation. The moisture barrier layer can be a biodegradable or compostable layer. In some implementations, the layer can be air-tight. In some implementations, the layer can be a plastic film.

In some implementations, the moisture barrier layer can be compostable, e.g., a bioplastic that meets ASTM D6400 standards. Example materials for a compostable layer include polymers based on one or more of polylactic acid (PLA), poly(beta-amino) esters (PBAE), polyhydroxyalkanoate (PHA), polycapralactones (PCL), polybutyrate adipate terephthalate (PBAT) polyvinylalcohol (PVA), or ethylene vinyl alcohol (EVOH). In addition, any combinations of these materials can be used for the layer. For example, a combination of PBAT and PE can be used for the layer. As another example, a combination of PE and PLA can be used for the moisture barrier layer. In some implementations, the polymer can be mixed with an organic product, e.g., starch or pulp, such as corn starch.

In some implementations, the moisture barrier layer can be recyclable and biodegradable. A suitable material for the recyclable layer is polyethylene, e.g., a polyethylene film. For example, the layer can include LDPE, MDPE, HDPE, or polyethylene terephthalate. An advantage of polyethylene is ease of fabrication and good water resistance.

In some implementations, the moisture barrier layer is a paper sheet. If the paper is thin enough or is perforated, the paper is compostable. Optionally, the paper can be lined with a water-repellant coating. Either the inner surface of the layer, or the outer surface, or both can be lined with the water-repellant coating. The water-repellant coating can be a compostable material, e.g., wax. In this case, the layer with paper and coating is compostable. Alternatively, the water-repellant coating can be a recyclable material. In this case, the layer with paper and coating is recyclable.

In some implementations, the moisture barrier layer provides a film that encloses the wall 20, e.g., the wall 20 is slidable within a pocket formed by the film. In some implementations, the film is secured to the wall 20 by an adhesive.

In some implementations, the moisture barrier layer directly coats the wall 20. The layer that directly coats the wall 20 can be composed of an organic compostable material, e.g., a wax. The layer can be spread in a thin layer on the surface of the wall 20. The layer can be applied in liquid form and then harden on the wall 20. Alternatively, the layer can be sprayed onto the wall 20. The sprayed-on layer can provide a moisture barrier. For example, a water-proof, water-resistant or water-repellant material can be sprayed onto the wall 20. In some implementations the layer can be polylactic acid (PLA).

A problem with a sheet formed of plant-fiber material is that it can be softened by water. If the item being shipped is cold or a coolant is placed in the interior of the compostable bulk shipper 10, condensation can form on the interior surfaces of the walls 20. However, the moisture barrier layer prevents liquid, e.g., the condensation, from reaching the plant fiber (as well as any starch within the interior spaces 38), thus enabling the compostable bulk shipper 10 to be usable as a thermally insulating compostable bulk shipper 10. However, in some implementations, the compostable bulk shipper 10 is exposed to the environment, i.e., there is no moisture barrier layer coating or surrounding the compostable bulk shipper 10.

In some implementations, a moisture barrier material to increase resistance of the walls 20 to water can be mixed with the starch and/or organic fiber. The material can be mixed with the starch or fiber while it is liquid form, e.g., with the fiber pulp, and then harden in the wall 20. Whether the resulting material of the walls 20 is water-proof, water-resistant or water-repellant can depend on the concentration of the material. In some implementations the material can be polylactic acid (PLA). In some implementations, the walls 20 consists of starch and/or plant fiber, in combination with the moisture barrier material.

Other materials that do not interfere with the compostable or recyclable nature of the walls 20, e.g., a preservative or anti-fungal agent, can be present, but only in small quantities. For example, at least 85%, e.g., at least 90-95%, by weight of the inner sheet 32 and outer sheet 34 is starch and/or pulp. Polyvinyl alcohol can be present, e.g., 5-10% by weight.

In some implementations, the wall 20 is entirely compostable, i.e., consists of compostable materials. In some implementations, the wall 20 is entirely recyclable, i.e., consists of recyclable materials. In some implementations, the wall 20 is formed of a combination of compostable and recyclable materials.

Examples of the compostable material(s) for the filler 33 in the interior space 38 of the wall include starch, plant fibers, or a combination of them. The starch can be a grain starch, e.g., a corn starch, a wheat starch or sorghum (sorghum is also known as milo), a root starch, e.g., a potato starch, or a vegetable starch. In some cases, a combinations of different starches can be used.

The filler 33 can be an organic fiber such as a plant fiber, e.g., a wood fiber or a vegetable fiber. For example, the plant fibers could be fibers from coconut husk, corn husk, linen, or cotton. In some cases, a combination of plant fibers from different plants can be used. The organic fiber can be formed by mixing fibers into a pulp, e.g., a paper pulp or pulp of vegetable fibers, and then extruding the pulp or compressing the pulp in a mold. Where the inner sheet 32 and outer sheet 34 of the walls 20 are formed from a paper pulp, the inner sheet 32 and outer sheet 34 can be considered to be formed of paper, e.g., a paperboard material.

In some implementations, a moisture barrier material to increase resistance of the walls 20 to water can be mixed with the filler 33. The material can be mixed with the filler 33.

The fibers for filler 33 differ from the fibers of the inner sheet 32 and the outer sheet 34. The fibers for the filler 33 can be loose fibers, rather than the fibers molded into the solid inner sheet 32 and the solid outer sheet 34. The fibers used for the filler 33 can also be a different material than the fibers used to mold the inner sheet 32 and the outer sheet 34. For example, the fibers used for the filler 33 can be vegetable fibers, e.g., fibers from coconut husk, corn husk, linen, or cotton, whereas the fibers used for the inner sheet 32 and outer sheet 34 are wood fibers. As another example, the fibers used for the filler 33 can be plant fibers while the fibers used for the inner sheet 32 and the outer sheet 34 can be plant fibers mixed with starch.

In some implementations, one or more pads 60 can be positioned adjacent to the inner surface of one or more walls. The pads can be coolant pads, e.g., gel-packs. In addition to one or more coolant packs positioned in the interior volume, one or more insulating pads can be positioned in the interior volume adjacent to one or more of the plurality of wall. each insulating pad is secured to the inner sheet of an adjacent wall. Alternatively, the pads can be additional layers of thermal insulation. The pads can sit loose in the interior of the shipper 10. Alternatively, the pads 60 can be secured to the inner sheets 32 using an adhesive (e.g., heat press or glue) or by interlocking with the grooves 36 (e.g., snap-fit of complementary shapes between the pads 60 and the grooves 36).

A variety of combinations of the features discussed above are possible. The drawings show only a limited number of possible combinations, and it should be assumed that the various features described can be used together in any consistent combination.

Although the description above has focused on bulk shippers, it is understood that this description can apply to any box, crate, container, or other similar item. For example, a container that can have an interior volume down to about 3000 cubic inches could be made using the techniques described above. In such a case, the length or width of the wall can be less than 2 feet. However, the description above is particularly useful for a bulk shipper, as the size of a container suitable for use a bulk shipper can necessitate fabricating the walls separately and joining them together.

A number of embodiments have been described. Nevertheless, it will be understood that various modifications may be made without departing from the spirit and scope of the invention. Accordingly, other embodiments are within the scope of the following claims.

What is claimed is:

1. A compostable or recyclable wall for forming a container, the wall comprising:

a first sheet and a second sheet, both formed primarily of paper pulp fibers; and a filler material of paper pulp fibers formed into a body and sandwiched between and substantially filling the space between the first sheet and the second sheet and wherein the filler material is completely enclosed, wherein the fibers of the body of the filler material are looser than the fibers of first sheet and the second sheet, and wherein the first sheet includes a flat inner main portion and the second sheet includes a flat outer main portion and the flat inner main portion and the flat outer main portion sandwich the filler material to form a generally planar body having a length of at least 2 feet, a width of at least 2 feet, a thickness that is less than the length and width, and wherein at least one of the first sheet or second includes a rim extending at a right angle from a respective main portion toward the other of the second sheet or first sheet to form an edge of the generally planar body between the flat outer main portion and the flat inner main portion and to cover the filler material along the edge.

2. The wall of claim 1, further comprising a moisture barrier in or on the compostable or recyclable wall.

3. The wall of claim 2, wherein the moisture barrier comprises a coating on the compostable or recyclable wall.

4. The wall of claim 1, wherein an adhesive joins the first sheet and the second sheet along adjacent edges.

5. A bulk shipper, the shipper comprising:

a plurality of walls that are compostable or recyclable, the plurality of walls including four side walls, a ceiling and a floor that provide exterior faces of the bulk shipper, at least each of the four side wall including an inner sheet and an outer sheet, both formed primarily of paper pulp fiber, an outer surface of the outer sheet providing an outermost surface of the bulk shipper that is exposed to an environment exterior of the bulk shipper, a filler material of paper pulp fiber formed into a body and sandwiched between and substantially filling the space between the inner sheet and the outer sheet and wherein the filler material is completely enclosed, wherein fibers of the body of the filler material are looser than the fibers of the inner sheet and the outer sheet, wherein the inner sheet includes a flat inner main portion and the outer sheet includes a flat outer main portion and the flat inner main portion and the flat outer main portion sandwich the filler material to form a generally planar body having a length of at least 2 feet, a width of at least 2 feet, and a thickness that is less than the length and width, and wherein at least one of the inner sheet or outer sheet includes a rim extending at a right angle from a respective main portion toward the other of the inner sheet or outer sheet to form an edge of the generally planar body between the flat outer main portion and the flat inner main portion and to cover the filler material along the edge;

wherein the side walls are secured to each other by mechanical fasteners to form the bulk shipper as a generally rectangular right prism having an interior volume of at least 8 cubic feet.

6. The bulk shipper of claim 5, wherein an adhesive joins the inner sheet and the outer sheet of each respective wall of the plurality of walls.

7. The bulk shipper of claim 5, wherein the side walls are secured by fasteners that clip walls to each other.

8. The bulk shipper of claim 5, wherein the plurality of walls are further secured to each other to form the bulk shipper by interlocking.

9. The bulk shipper of claim 5, further comprising a pallet supporting the plurality of walls.

10. The bulk shipper of claim 5, wherein the inner sheet and the outer sheet each comprises a moisture barrier material mixed with plant fiber pulp.

11. The bulk shipper of claim 5, wherein each respective wall of the plurality of walls comprises a moisture barrier material coating an inner surface of the respective wall.

12. The bulk shipper of claim 5, wherein the filler material comprises a moisture barrier material mixed with the fibers of the paper pulp.

13. The bulk shipper of claim 5, wherein the moisture barrier material comprises polylactic acid (PLA).

14. The bulk shipper of claim 5, wherein the inner sheet and the outer sheet are each 0.7 mm to 10 mm thick.

15. The bulk shipper of claim 5, wherein each wall has a thickness of 0.5 to 10 inches.

16. The bulk shipper of claim 5, further comprising a moisture barrier layer that includes paper lined with a water-repellant coating.

17. A bulk shipper, the shipper comprising:

a plurality of walls that are compostable or recyclable, the plurality of walls including four side walls, a ceiling and a floor that provide exterior faces of the bulk shipper and enclose an interior volume to hold goods to be shipped, at least each of the four side walls including an inner sheet and an outer sheet, both formed primarily of paper pulp fiber, an outer surface of the outer sheet providing an outermost surface of the bulk shipper that is exposed to an environment exterior of the bulk shipper, an interior surface of the inner sheet defining the interior volume, the inner sheet and the outer sheet each having a thickness of 0.7 mm to 10 mm, a filler material of paper pulp fiber formed into a body and sandwiched between and substantially filling the space between the inner sheet and the outer sheet, wherein the filler material is completely enclosed, wherein fibers of the body of the filler material are looser than the fibers of the inner sheet and the outer sheet, wherein the inner sheet includes a flat inner main portion and the outer sheet includes a flat outer main portion and the flat inner main portion and the flat outer main portion sandwich the filler material to form a generally planar body having a length of at least 2 feet, a width of at least 2 feet, and a thickness of 0.5 to 10 inches, and wherein at least one of the inner sheet or outer sheet includes a rim extending at a right angle from a respective main portion toward the other of the inner sheet or outer sheet to form an edge of the generally planar body between the flat outer main portion and the flat inner main portion and to cover the filler material along the edge;

wherein the side walls are secured to each other by mechanical clip fasteners to form the bulk shipper as a generally rectangular right prism having an interior volume of at least 8 cubic feet; and a pallet supporting the plurality of walls.

* * * * *